US006881087B2

(12) United States Patent
Norris et al.

(10) Patent No.: US 6,881,087 B2
(45) Date of Patent: Apr. 19, 2005

(54) SPRING ASSISTED LEVER ACTUATED SOCKET

(75) Inventors: Nathan John Norris, Palmyra, PA (US); Richard N. Whyne, Camp Hill, PA (US); David A. Trout, Lancaster, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/624,230

(22) Filed: Jul. 22, 2003

(65) Prior Publication Data

US 2005/0020118 A1 Jan. 27, 2005

(51) Int. Cl.[7] ..... H01R 13/62
(52) U.S. Cl. ..... 439/342; 439/259
(58) Field of Search ..... 439/342, 259–260, 439/525

(56) References Cited

U.S. PATENT DOCUMENTS 3,763,459 A 10/1973 Millis ..... 439/242
5,013,256 A * 5/1991 Matsuoka et al. ..... 439/264
5,123,855 A 6/1992 Petersen ..... 439/263
5,256,080 A * 10/1993 Bright ..... 439/342
5,482,471 A 1/1996 Mori et al. ..... 439/263
5,730,616 A 3/1998 Nakamura ..... 439/342
6,338,639 B1 * 1/2002 Trout et al. ..... 439/342
6,368,137 B1 * 4/2002 Orwoll ..... 439/331
6,371,786 B1 4/2002 Howell et al. ..... 439/342
6,406,317 B1 * 6/2002 Li et al. ..... 439/342
6,508,659 B1 1/2003 Howell et al. ..... 439/342
6,544,065 B1 4/2003 Howell et al. ..... 439/242

* cited by examiner

*Primary Examiner*—Hien Vu

(57) ABSTRACT

A socket for an electronic package includes a cover and a base slidably joined with one another. A cam assembly drives the cover relative to the base between open and closed positions, and a bias element directly contacts the cam assembly to force the cam assembly to a fully open position when the cam assembly is moved from the closed position. The cam assembly is adapted for linear displacement relative to the base when actuated, and the bias element exerts a force on the cam assembly to locate the cover in the open position. The bias element is located between the cover and the base.

19 Claims, 7 Drawing Sheets

SPRING ASSISTED LEVER ACTUATED SOCKET

BACKGROUND OF THE INVENTION

The present invention generally relates to an electrical socket, such as a pin grid array (PGA) socket. More specifically, certain embodiments of the present invention relate to a zero insertion force (ZIF) PGA socket with a spring assisted actuation lever.

Heretofore, ZIF PGA sockets have been proposed that include a base and cover slidably mounted together. The sliding motion between the base and cover is controlled with an actuator through numerous methods in conventional ZIF PGA sockets. For example, U.S. Pat. No. 5,256,080 discloses a bale actuated ZIF socket, while U.S. Pat. No. 4,498,725 discloses a PGA socket having an L-shaped lever that moves the cover. The PGA sockets of the '080 and '725 patents have actuators typically (but not always) that are configured to operate over a 90-degree range of rotation. As the actuator is rotated from one end point to the opposite end of this 90-degree range of rotation, the actuator moves the cover between fully opened and fully closed positions. The foregoing sockets, however, do not meet the space requirements placed on current designs. Consequently, new sockets have been proposed having different actuators that afford a more space efficient overall socket configuration.

For example, recently, a socket has been introduced, in which the cover and base are movable between open and closed positions along a socket longitudinal axis by an actuator that is aligned to rotate about a rotational axis that is parallel to the socket longitudinal axis. The actuator moves the cover and base between open and closed positions or states as the actuator is rotated about the rotational axis. A PGA socket of this type is described in U.S. Pat. No. 6,338,639.

However, certain embodiments of the socket of the '639 patent, while more space efficient, utilize a longer actuator range of motion than previous sockets. For example, the actuator may rotate through a 135-degree range of rotation to move the cover between fully opened and closed positions. This extended range of motion has caused some confusion for users who normally expect the cover to be fully opened when the actuator is rotated 90 degrees from its closed position as with previous sockets. Consequently, sockets having the longer range of rotation for the actuator are sometimes not fully opened prior to the user attempting to load an electronic package therein. The electronic package may become damaged if loaded when the cover is only partially opened. Such damage may arise if pins on the electronic package are forced into a partially open pin hole array in the cover. The pins on the electronic package may also only sit on top of, without becoming fully seated to, the contacts held in the socket. When the pins on the electronic package and the contacts in the socket are only partially joined, a risk exists for arcing during operation. For the foregoing reasons and others, it is desirable that the user fully open the socket before loading an electronic package.

In an attempt to ensure that the socket is fully opened before loading of an electronic package, at least one socket having a longer actuator range of motion (i.e., greater than 90 degrees) includes a spring coupled to an actuator lever to force the lever to a fully open position and to maintain the socket in the open position. The spring, however, is located externally to the base and the cover on the actuator lever, and the actuator lever must be modified to accommodate the spring. Specifically, the length of the actuator lever must be increased to allow room for the spring. Increasing the lever length is undesirable as it increases the space occupied by the socket in use.

BRIEF DESCRIPTION OF THE INVENTION

In an exemplary embodiment, a socket for an electronic package comprising a cover and a base slidably joined with one another is provided. A cam assembly drives the cover relative to the base between open and closed positions, and a bias element directly contacts the cam assembly to force the cam assembly to a fully open position when the cam assembly is moved from the closed position.

Optionally, the cam assembly is adapted for linear displacement relative to the base when actuated, and the bias element exerts a force on the cam assembly to locate the cover in the open position. The bias element may be, for example, a helical spring, and the spring is located between the cover and the base. The base comprises a bias element seat and the actuator comprises a bias element seat, and the bias element seat of the base and the bias element seat of the actuator surround the bias element. The cam assembly comprises a cam lobe portion and a bias element engagement shoulder extending from the cam lobe portion, and the bias element contacts the bias element engagement shoulder.

In another exemplary embodiment, a socket for an electronic package is provided. The socket comprises a cover and a base slidably joined with one another and being movable relative to one another along a longitudinal axis between open and closed positions. A cam assembly engages and moves the cover and base between the open and closed positions, and a rotatably mounted lever is configured to engage the cam assembly when the lever is rotated about a rotational axis aligned parallel to the longitudinal axis. A bias element is seated between the cover and base and engages the cam assembly to prevent partial opening of the cover relative to the base.

In another exemplary embodiment, a socket for an electronic package is provided. The socket comprises a cover and a base slidably joined with one another and being movable relative to one another along a longitudinal axis between open and closed positions. A cam assembly engages and moves the cover between the open and closed positions, and the cam assembly is adapted for linear displacement in a direction perpendicular to the longitudinal axis. A rotatably mounted lever is configured to engage and displace the cam assembly when the lever is rotated about a rotational axis aligned parallel to the longitudinal axis. A bias element extends between the cover and base without contacting the lever, and the bias element exerts a force upon the cam assembly to ensure that the cover is in an open position relative to the base when the lever is actuated to open the socket.

DETAILED DESCRIPTION OF THE INVENTION

Figure 1:
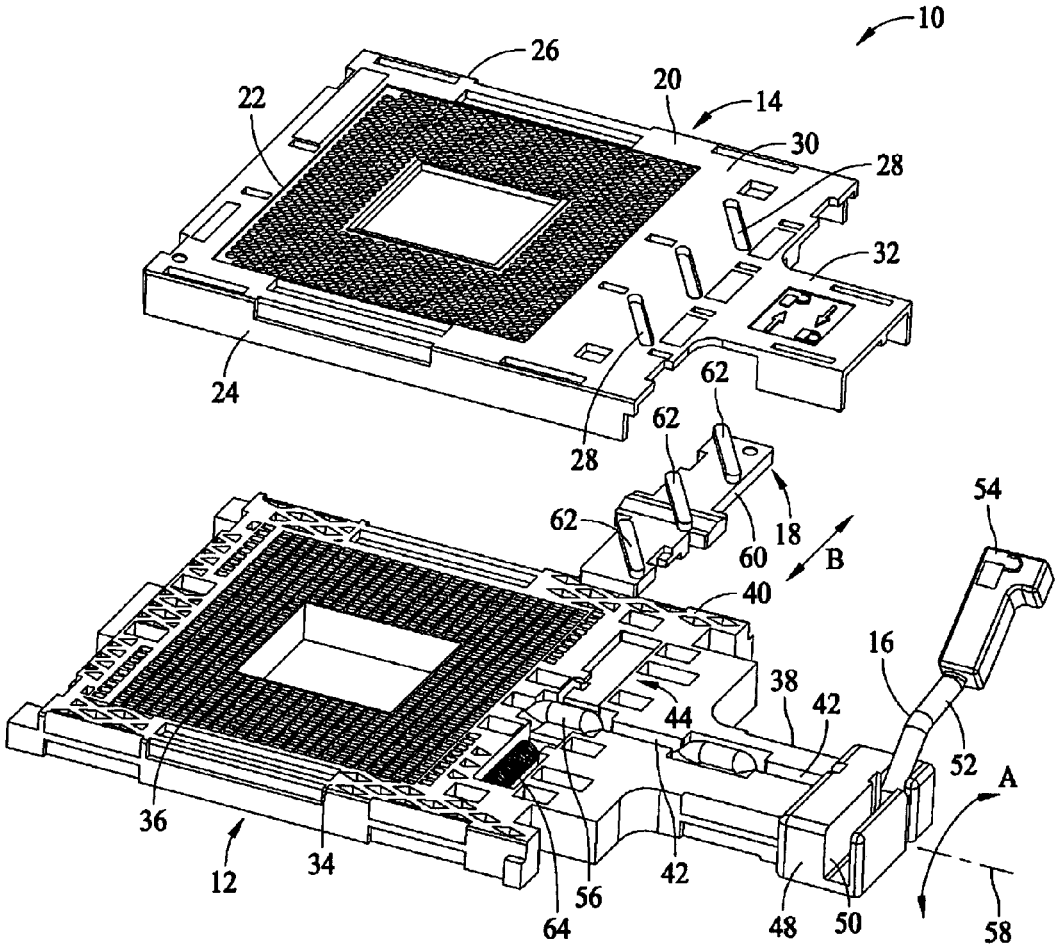
FIG. 1 is an exploded view of an exemplary socket formed in accordance with an embodiment of the present invention.

FIG. 1 illustrates an exemplary socket 10 formed in accordance with an embodiment of the present invention. The socket 10 generally includes a base 12 and a cover 14 slidably engaging one another. The base 12 and cover 14 are moved between an open and closed position (explained below) by an actuation member, such as a lever 16, which rotates along an arcuate path A between the open position and the closed position as explained below. The lever 16 actuates a cam assembly 18 described below to move the cover 14 relative to the base 12.

The cover 14 includes a substantially rectangular body 20 having a pin hole pattern 22 therein which corresponds to, for example, a processor pin pattern. Side rails 24 and 26 depend from opposite sides of the body 20 and are adapted for sliding engagement with the base 12. Angled slots 28 are formed in the cover 14 on a forward end 30 of the body 20, and a hood 32 extends from the forward end 30 and projects outwardly from the body 20.

The base 12 includes a substantially rectangular body 34 on which a pin pattern 36 is formed. A shroud 38 is formed on a forward end 40 of the body 34. An elongated slot 42 extends through the shroud 38 to a recessed cam assembly pocket 44 formed in the forward end 40 of the body 34. The cam assembly pocket 44 is shaped complementary to the outer profile of the cam assembly 18, and the cam assembly 18 is slidably engaged to the cam assembly pocket 44 for movement between the open and closed positions of the socket 10. The slot 42 extends from a head 48 of the shroud 38 to the cam assembly pocket 44 and forms a path for the lever 16 to actuate the cam assembly 18 within the cam assembly pocket 44. The head 48 also includes a slot 50 extending therefrom generally at a right angle to the slot 42. The slot 50 also forms a path for a portion of the lever 16, as described below.

In an illustrative embodiment the shroud 38 and the head 48 are integrally formed with one another and also with the body 34 of the base 12. Optionally, the shroud 38, the head 48 and the body 34 may not necessarily be formed integral with the base 12, but instead may be joined to one another through a variety of processes or techniques familiar to those in the art.

The lever 16 drives the cam assembly 18 that is held between the base 12 and cover 14 in the manner described below. In an exemplary embodiment, the cam assembly 18 may be formed similar to the cam assembly described in U.S. Pat. No. 6,338,639, which is expressly incorporated by reference herein in its entirety.

In an illustrative embodiment the lever 16 includes a handle portion 52 extending from the head 48, and a handle 54 is attached to the handle portion 52. The lever 16 extends between the base 12 and cover 14 in the slot 42 through the shroud 38. The lever 16 includes a cam element lobe 56 that engages the cam assembly 18 as described below. As the lever 16 rotates about its longitudinal axis 58 along the path of arrow A, the cam element lobe 56 drives the cam assembly 18 along a linear path denoted by arrow B.

The cam assembly 18 includes a body 60 having pusher bars 62 projecting upward therefrom through the angled slots 28 formed in the cover 14. The pusher bars 62 are slidably received within the slots 28 and are arranged such that the longitudinal axes of each of the pusher bars 62 extend parallel to one another and are aligned at an acute angle with respect to the linear path B along which the cam assembly 18 travels. As the cam assembly 18 moves in the direction of arrow B, the pusher bars 62 slidably engage the side walls of the slots 28 in the cover 14, thereby causing the cover 14 to slide relative to the base 12, along a path perpendicular to linear path B, between the open and closed states.

In an exemplary embodiment, the lever 16 is rotatable about the longitudinal axis 58 such that arcuate path A traveled by the handle 54 is approximately 135 radial degrees between the open position (as illustrated in FIG. 1) and the closed position. To ensure that the socket 10 is in the fully opened position before loading of an electronic package into the socket 10, however, a bias element 64 is provided internal to the cover 14 and the base 12. The bias element 64 directly contacts the cam assembly 18 in the cam assembly pocket 44. As explained below, the bias element 64 provides a force to the cam element lobe 56 of the lever 16 as the lever 16 is rotated from the closed position to the open position. In other words, the bias element 64 urges the lever 16 to the open position once the lever 16 is actuated and prevents the lever 16 from being inadvertently positioned between the open and closed positions. As such, partial opening of the socket 10 is avoided, and so are the associated problems with loading electronic packages when the socket is not fully opened.

In an exemplary embodiment the bias element 64 is a helical compression spring element, although in alternative embodiments other known biasing members may be employed while achieving similar benefits to the present invention, including but not limited to tension spring elements, torsion spring elements, and other known resilient elements for providing a spring action force.

When the socket 10 is assembled, the cover 14 is slidably engaged to the base 12 via the side rails 24 and 26, and the cam assembly 18 is located in the cam assembly pocket 44 between the cover 14 and the base 12. The pusher bars 62 of the cam assembly 18 are located in the angled slots 28 of the cover 14, and the hood 32 of the cover 14 is fitted over the shroud 38 of the base 12. The head section 48 of the base 12 is exposed when the socket 10 is assembled, thereby providing access to the lever 16 and the handle 54 for actuation of the socket between the open and closed positions.

Figure 2:
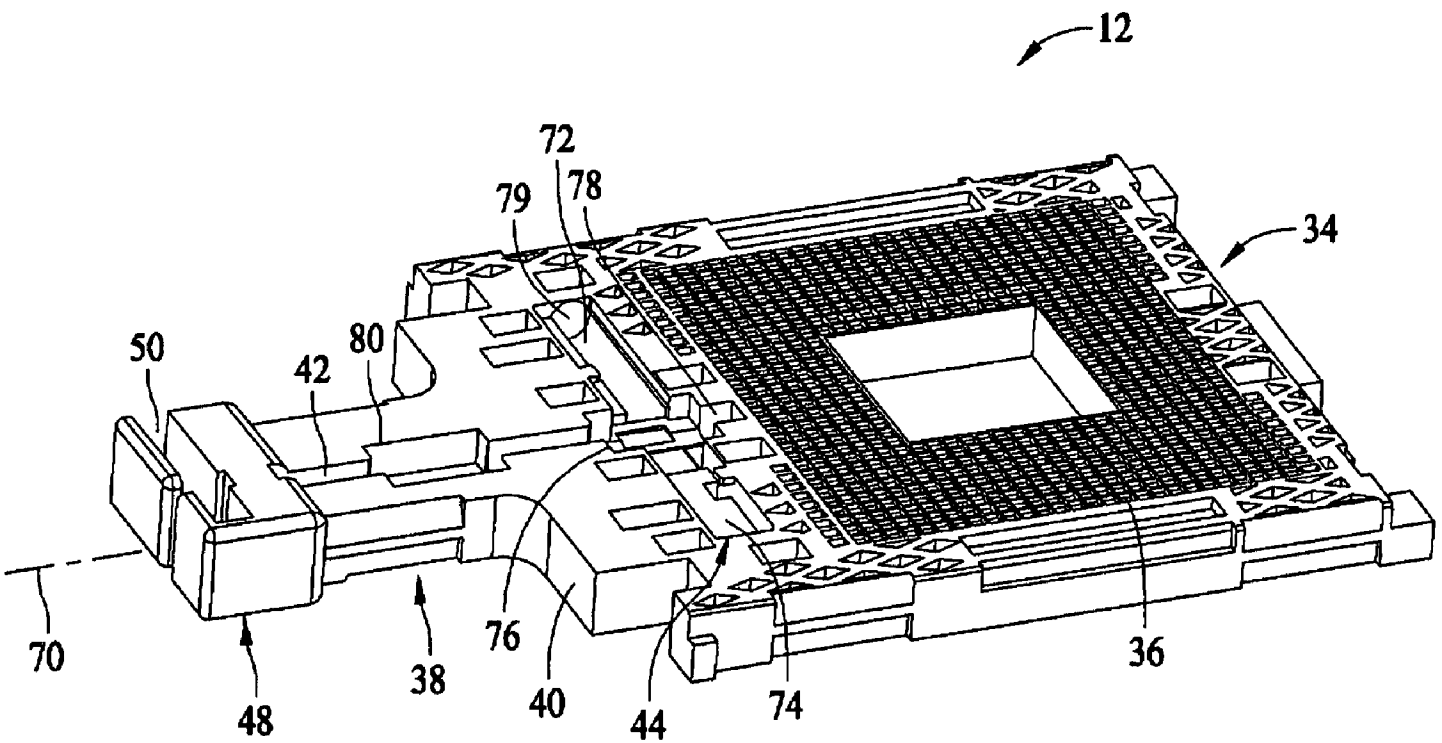
FIG. 2 is a perspective view of an exemplary base for the socket shown in FIG. 1.

FIG. 2 illustrates the base 12 of the socket 10 (shown in FIG. 1). The base 12 includes a substantially rectangular body 34 on which the pin pattern 36 is formed and a shroud 38 formed on a central portion of the forward end 40 and extending outward therefrom. The cam assembly pocket 44 is located in the body 34 between the pin pattern 36 and the shroud 38 and includes a recessed surface relative to the body 34. The cam assembly pocket 44 is positioned transverse to a longitudinal axis 70 extending through the base 12 and is shaped generally complementary to the outer profile of the cam assembly 18 (shown in FIG. 1). In the illustrated embodiment, the cam assembly pocket 44 includes a generally cylindrical shaped bias element seat 72 at one end, a generally flat shelf 74 on an opposite end, and a central lobe section 76 between the bias element seat 72 and the flat shelf 74. The central lobe section 76 includes a longitudinal notch 78 which receives an end of the lever 16 (shown in FIG. 1). The bias element seat 72 includes a stop surface 79 at one end thereof and is open at an opposite end proximate the central lobe section 76. By providing the bias element seat 72 in the cam assembly pocket 44, the bias element 64 may directly bias the cam assembly 18 in the open position without any modification of the lever 16 (shown in FIG. 1).

The slot 42 extends longitudinally through the shroud 38 from the head 48 to the cam assembly pocket 44 and forms a path for the lever 16 (shown in FIG. 1) to actuate the cam assembly 18 (shown in FIG. 1) within the cam assembly pocket 44. The head 48 includes the slot 50 extending therefrom generally at a right angle to the slot 42. The slot 50 also forms a path for a portion of the lever 16, as described below. Optionally, a widened pocket 80 is formed in the slot 42 between the central lobe section 76 and the head 48.

Figure 3:
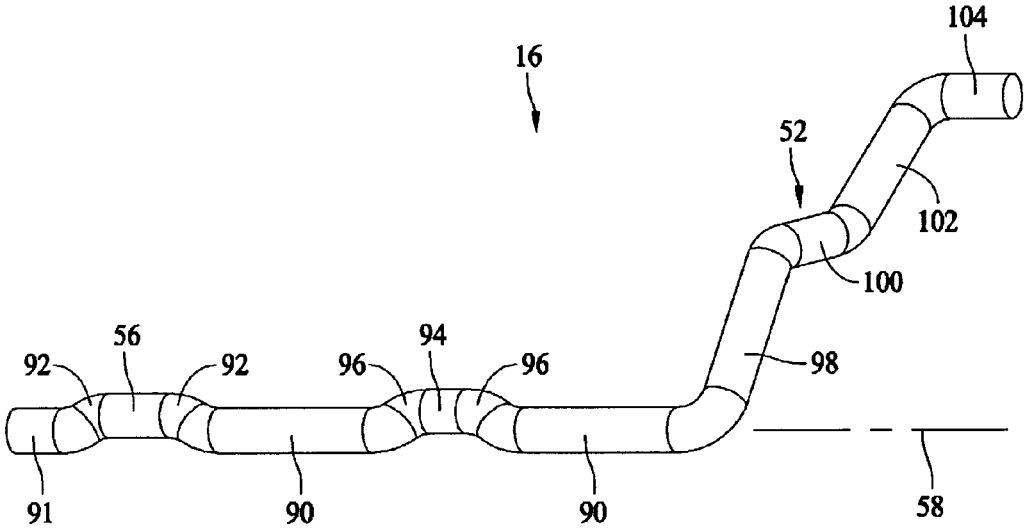
FIG. 3 is a perspective view of an exemplary actuation lever for the socket shown in FIG. 1.

FIG. 3 is a perspective view of the lever 16 illustrating a longitudinal portion 90 extending along the longitudinal axis 58 of the lever 16 and the cam element lobe 56 proximate a free end 91 of the longitudinal portion 90. The cam element lobe 56 is stepped outward from the longitudinal axis 58 via radially extending transition portions 92. For example, the cam element lobe 56 is offset from the longitudinal portion 90 of the lever 16 and extends substantially parallel to the longitudinal axis 58. When the free end 91 of the lever 16 is positioned in the longitudinal notch 78 (shown in FIG. 2) of the base 12, the cam element lobe 56 is positioned in the central lobe section 76 (shown in FIG. 2) of the cam assembly pocket 44 (shown in FIG. 2). As the lever 16 is rotated about the longitudinal axis 58, the cam element lobe 56 contacts the cam assembly 18 (shown in FIG. 1) for actuation of the cover 14 relative to the base 12.

Optionally, a secondary lobe 94 is stepped outward from the longitudinal axis 58 via radially extending transition portions 96. For example, the secondary lobe 56 is offset from the longitudinal portion 90 of the lever 16 and extends substantially parallel to the longitudinal axis 58. The secondary lobe 94 may be positioned in the pocket 80 (shown in FIG. 2) of the slot 42 (shown in FIG. 2). As the lever 16 is rotated about the longitudinal axis 58, the secondary lobe 94 may provide, for example, an indicating function to readily identify the cover 14 as open or closed.

The handle portion 52 of the lever 16 includes a first leg 98 extending radially from, or substantially perpendicular to, the longitudinal portions 90 of the lever 16. First, second and third angled sections 100, 102 and 104 extend from the first leg 98 and the second and third angled sections 102 and 104 are adapted to be received by the handle 54 (shown in FIG. 1).

While one exemplary shape of the lever 16 is illustrated, it is recognized that a variety of alternative shapes may be employed in various embodiments of the invention without departing from the scope and spirit of the instant invention.

Figure 4:
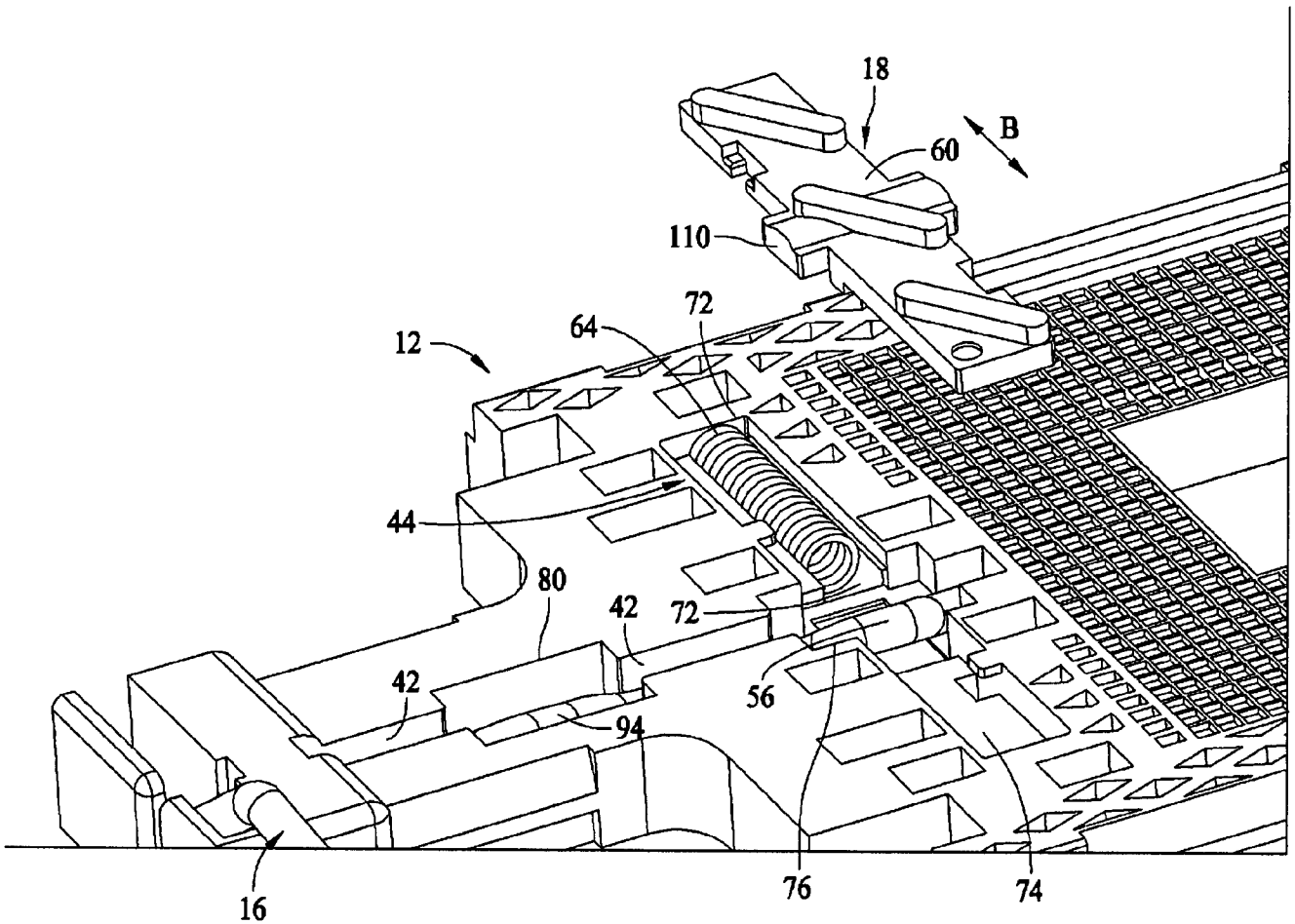
FIG. 4 is an assembly view of a portion of the socket shown in FIG. 1.

FIG. 4 is an assembly view of the base 12 with the bias element 64 located in the cam assembly pocket 44 upon the bias element seat 72. The cam element lobe 56 of the lever 16 is located in the central lobe section 76 of the cam assembly pocket 44, and the secondary lobe 94 of the lever 16 is positioned in the pocket 80, with the remainder of the longitudinal portion 90 (shown in FIG. 3) of the lever 16 located in the slot 42. The cam assembly 18 is positioned over the cam assembly pocket 44. The body 60 of the cam assembly 18 is fitted within the portions 72 and 74 of the cam assembly pocket 44. The cam assembly 18 includes a central lobe portion 110 which is fitted within the central lobe section 76 of the cam assembly pocket 44. The cam element lobe 56 of the lever 16 contacts an underside of the central lobe portion 110 of the cam assembly 18 to actuate the cam assembly 18 in the direction of arrow B as the lever 16 is rotated about the longitudinal axis 58 (shown in FIGS. 1 and 3).

As illustrated in FIG. 4, the lever 16 is illustrated in the open position approximately 135° from the closed position, and the cam element lobe 56 of the lever 16 is inclined toward the flat shelf 74 of the cam assembly pocket 44. In the closed position, the cam element lobe 56 is rotated toward the bias element seat 72 of the cam assembly pocket 44 until the cam element lobe 56 is substantially aligned with and directly opposed to the bias element 64. As such, static equilibrium is achieved between the cam element lobe 56 and the bias element 64, through the cam assembly 18, when the lever 16 is in the closed position. However, when the lever 16 is rotated from the closed position, the static equilibrium between the bias element 64 and the cam element lobe 56 is lost, and the bias element 64 pushes the cam element 18 to the open position as further described below. The cam element lobe 56 therefore has only two stable positions, namely the open position and the closed position. At any intermediate position, the bias element 64 will force the cam element lobe 56 to the open position.

Figure 5:
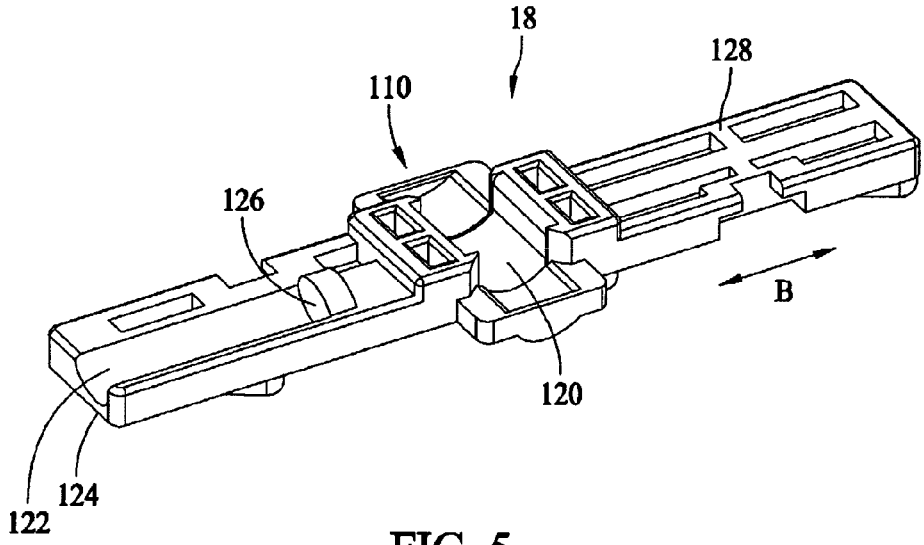
FIG. 5 is a bottom perspective view of an exemplary cam assembly shown in FIGS. 1 and 4.

FIG. 5 is a bottom perspective view of the cam assembly 18 illustrating an arcuate surface 120 in the central lobe portion 110. As the lever 16 (shown in FIGS. 1, 3 and 4) is rotated about the longitudinal axis 58 (shown in FIGS. 1 and 3), the cam element lobe 56 (shown in FIG. 4) contacts the arcuate surface 120 and displaces the cam assembly 18 in a direction of arrow B. Depending on the direction of rotation of the lever 16 about the longitudinal axis 58 (e.g., clockwise or counterclockwise) the cam assembly 18 is moved in one of opposite directions as indicated by the arrow B.

The cam assembly 18 includes a generally cylindrical shaped bias element seat 122 recessed therein and situated on one side of the central lobe portion 110. The bias element seat 122 is open on a first end 124, and an opposite end of the bias element seat 122 includes a bias element engagement shoulder 126. The bias element seat 122 sits above the bias element seat 72 (shown in FIG. 2) of the cam assembly pocket 44 (shown in FIG. 2) when the cam assembly 18 is received in the cam assembly pocket 44. A flat shelf 128 extends from the central lobe portion 110 opposite the bias element seat 122. The flat shelf 128 rests upon the flat shelf 74 (shown in FIG. 2) of the cam assembly pocket 44 when the cam assembly 18 is received in the cam assembly pocket 44.

Figure 6:
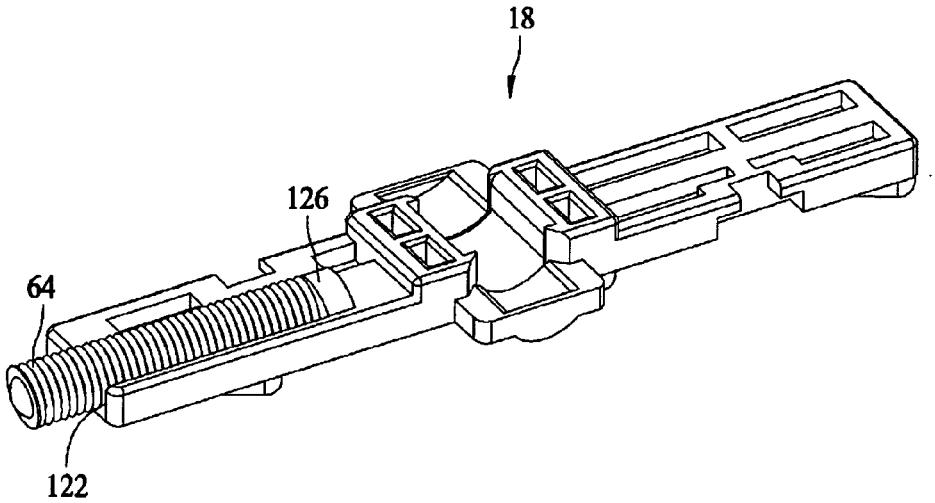
FIG. 6 is a bottom perspective view of the cam assembly shown in FIG. 5 loaded with a bias element.

FIG. 6 illustrates the cam assembly 18 with the bias element 64 loaded therein upon the bias element seat 122. One end of the bias element 64 is abutted against the engagement shoulder 126, and the other end of the bias element 64 extends from the bias element seat 122 for abutment with the stop surface 79 (shown in FIG. 2) in the cam assembly pocket 44. When assembled, the bias element 64 extends between the stop surface 79 in the cam assembly pocket 44 and the engagement shoulder 126 of the cam assembly 18.

Figure 7:
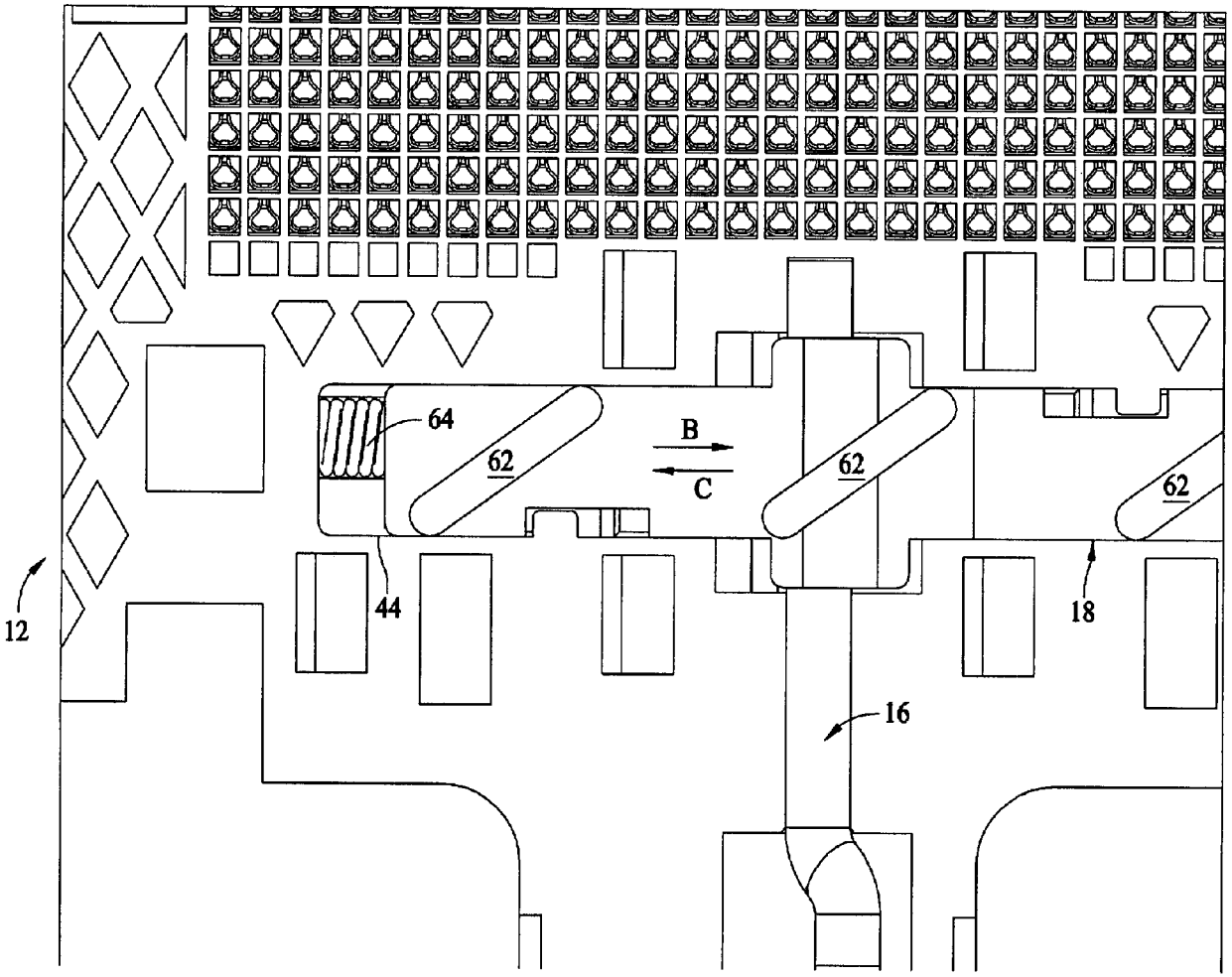
FIG. 7 is a top plan view of an assembled socket.

FIG. 7 is a top plan view of the cam assembly 18 located within the cam assembly pocket 44 in the open position. The bias element 64 is surrounded by the bias element seat 72 (shown in FIG. 2) in the cam assembly pocket 44 of the base 12 and the bias element seat 122 (shown in FIG. 5) with the opposite ends of the bias element 64 engaged to the stop surface 79 (shown in FIG. 2) in the cam assembly pocket 44 and the engagement shoulder 126 (shown in FIGS. 5 and 6) of the cam assembly 18. The bias element 64 in the open position exerts a force against the engagement shoulder 126 in the direction of arrow B, thereby maintaining the cam element lobe 56 (shown in FIGS. 1 and 3) of the lever 16 in contact with the arucate surface 120 (shown in FIG. 4) of the cam lobe portion 110 of the cam assembly 18. Contact of the cam element lobe 56 with the arcuate surface 120 displaces the cam assembly 18 within the cam assembly pocket 44 in the direction of arrow B to the open position. Displacement of the cam assembly 18, in turn, shifts a position of the pusher bars 62 in the angled slots 28 (shown in FIG. 1) in the cover 14, and displaces the cover 14 to the open position. The force exerted by the bias element 64 forces the lever 16 to the fully open position and maintains the lever 16 in the open position.

When the lever 16 is rotated to the closed position, the cam element lobe 56 contacts the opposite side of the arcuate surface 120 of the cam lobe portion 110 and displaces the cam assembly 18 in the direction of arrow C against the bias of the bias element 64. The bias element 64 is therefore compressed or loaded as the cam assembly 18 is moved in the direction of arrow C until the cam element lobe 56 is substantially aligned with and opposed to the longitudinal axis 58 of the bias element 64 and a state of static equilibrium is achieved in the closed position. If the lever 16 is rotated toward the open position, however, the compressed bias element 64 exerts a force in the direction of arrow B to displace the cam assembly 18 and fully open the socket 10.

Figure 8:
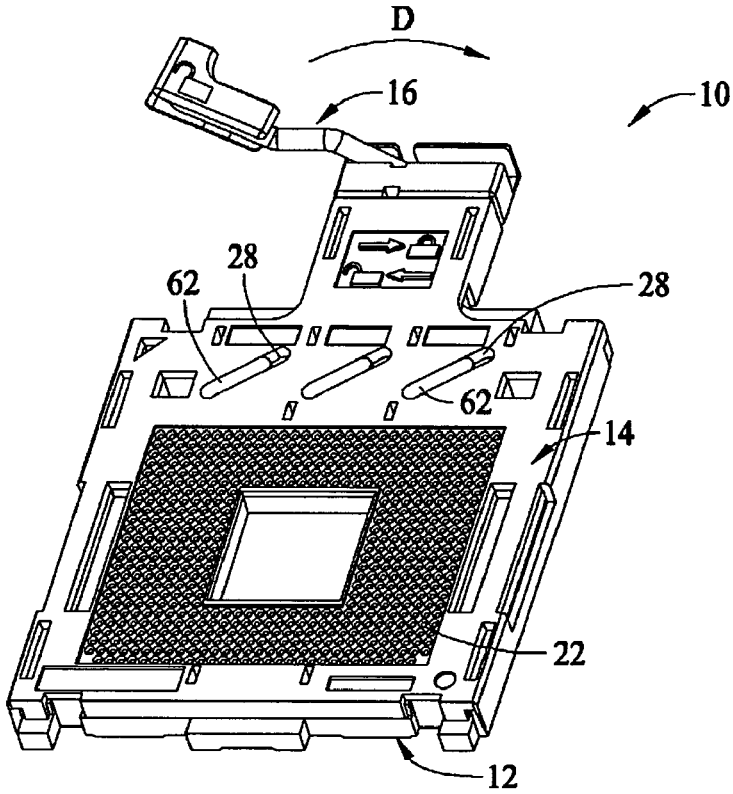
FIG. 8 is a perspective view of the socket shown in FIG. 1 while in a fully opened state.

FIG. 8 is a perspective view of the assembled socket 10 in the open position. The bias element 64 (shown in FIG. 7) displaces the cam assembly 18 so that the pusher bars 62 contact an end of the angled slots 28 nearer to the pin pattern 22 in the cover 14. The cover 14 is thereby located in a fully opened position relative to the base 12. In the open position, an electronic package (not shown) may be safely loaded into the socket 10. Once the electronic package is loaded, the lever 16 may be rotated in the direction of arrow D to close the socket 10. As the lever 16 is moved to the closed position, the bias element 64 (shown in FIG. 7) is compressed by the cam element lobe 56 (shown in FIG. 4) as the socket 10 is closed.

Figure 9:
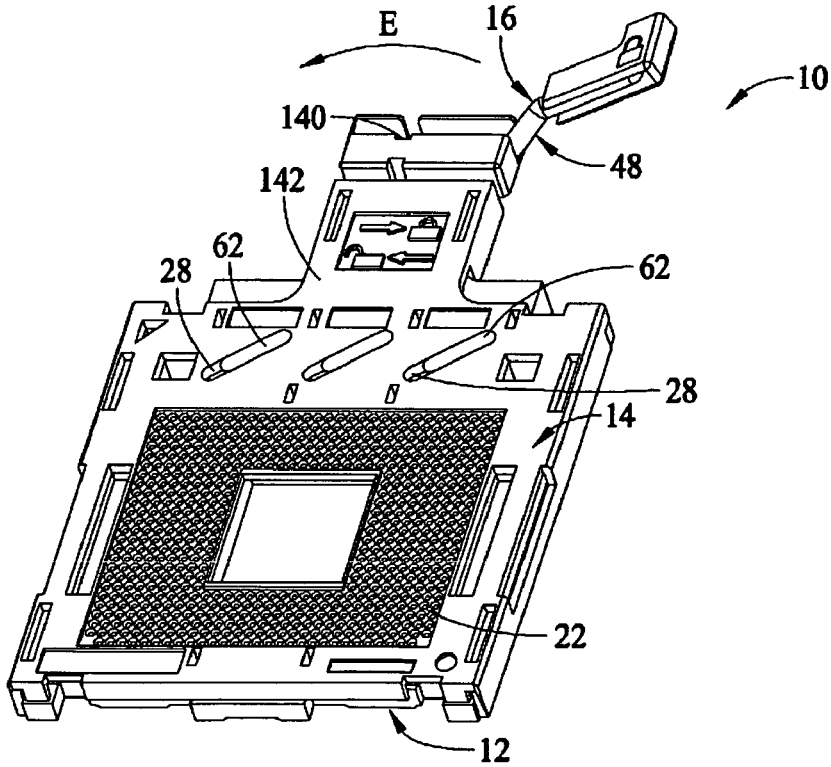
FIG. 9 is a perspective view of the socket shown in FIG. 1 while in a fully closed state.

FIG. 9 illustrates the socket 10 in the closed position wherein the handle 54 is rotated approximately 135° from the open position shown in FIG. 8. In the closed position, the bias element 64 (shown in FIG. 7) is compressed by the cam element lobe 56 (shown in FIG. 4) as the socket 10 is closed and the cam assembly 18 (shown in FIG. 7) is in static equilibrium with the bias element 64 via the cam element lobe 56 positioned in direct opposition to the bias element 64 in the cam lobe portion 110 of the cam assembly 18. The cam assembly 18 is positioned so that the pusher bars 62 contact an end of the angled slots 28 away from the pin pattern 22 in the cover 14, thereby positioning the cover 14 in a fully closed position relative to the base 12. From the closed position, the lever 16 may be rotated in the direction of arrow E to open the socket 10.

As illustrated in FIG. 9, the head 48 of the base 12 includes a stop 140 formed therein. The stop 140 includes a sloped surface extending at an obtuse angle to the plane of the top surface 142 of the cover 14. The lever 16 is rotated in the direction of arrow E until the lever 16 rests against the stop 140 in the closed position at an obtuse angle with respect to the plane of the cover 14, as illustrated in FIG. 8.

The above described socket 10 thereby provides assurance that the socket 10 is completely opened for loading of electronic packages therein. Associated damage and reliability issues of packages inserted into partially opened sockets is therefore avoided. Further, the above-described construction accomplishes the noted benefits without modification to the actuation lever and without impacting the external dimensions of the socket. The socket therefore occupies the same area, sometimes referred to as a "footprint", as a comparable socket without the spring assisted lever.

While the invention has been described in terms of various specific embodiments, those skilled in the art will recognize that the invention can be practiced with modification within the spirit and scope of the claims.

What is claimed is:

1. A socket for an electronic package, comprising:

a cover and a base slidably joined with one another;

a sliding cam assembly sliding and driving said cover relative to said base, said cam assembly positionable between open and closed positions corresponding to open and closed positions of the cover with respect to the base; and a bias element directly contacting the cam assembly to force the cam assembly to a fully open position when the cam assembly is moved from the closed position said cam assembly having a bias element seat for receiving the bias element therein.

2. The socket of claim 1, wherein said cam assembly comprises a bias element stop surface.

3. The socket of claim 1, wherein said base comprises a cam assembly pocket, said cam assembly pocket comprising a bias element engagement surface.

4. The socket of claim 1, wherein said cam assembly is adapted for linear displacement relative to said base when actuated, said bias element exerting a force on said cam assembly to locate said cover in the open position.

5. The socket of claim 1 wherein said bias element is a helical spring, said spring located between said cover and said base.

6. The socket of claim 1, wherein said base comprises a bias element seat, said bias element seat of said base and said bias element seat of said cam assembly surrounding said bias element.

7. The socket of claim 1, wherein said cam assembly comprises pusher bars extending from a body, said bias element displacing said body relative to said base, said pusher bars displacing said cover relative to said base.

8. The socket of claim 1, wherein said cam assembly comprises a cam lobe portion and a bias element engagement shoulder extending from said cam lobe portion, said bias element contacting said bias element engagement shoulder.

9. The socket of claim 1, wherein, said bias element seat comprising an open end and a bias element engagement surface opposite said open end.

10. The socket of claim 1, further comprising a rotatably mounted lever comprising a cam element lobe, said cam element lobe contacting said cam assembly as said lever is rotated, said bias element contacting said cam assembly to maintain said cam element lobe in an open position when said lever is rotated from a closed position.

11. A socket for an electronic package, comprising:

a cover and a base slidably joined with one another and being movable relative to one another along a longitudinal axis between an open position permitting loading of the electronic package into the socket and a closed position engaging the electronic package to the base;

a sliding cam assembly sliding and moving said cover and base between said open and closed positions;

a rotatably mounted lever configured to engage said cam assembly when said lever is rotated about a rotational axis aligned parallel to said longitudinal axis; and said cam assembly having a bias element seat and a bias element seated between said cover and base and engaging said cam assembly to prevent partial opening of said cover relative to said base.

12. The socket of claim 11, wherein said cam assembly comprises a bias element stop surface, said bias element engaged to said stop surface.

13. The socket of claim 11, wherein said base comprises a cam assembly pocket, said cam assembly pocket comprising a bias element engagement surface.

14. The socket of claim 11, wherein said cam assembly is adapted for linear displacement in a direction perpendicular to said longitudinal axis when actuated, said bias element exerting a force on said cam assembly to displace said cover relative to said base.

15. The socket of claim 11 wherein said bias element is a helical spring, said spring located between said cover and said base without contacting said lever.

16. The socket of claim 11, wherein said base comprises a bias element seat, said bias element seat of said base and said bias element seat of said cam assembly surrounding said bias element.

17. The socket of claim 11, wherein said cam assembly comprises a cam lobe portion and a bias element engagement shoulder extending from said cam lobe portion, said bias element contacting said bias element engagement shoulder.

18. The socket of claim 11, wherein, said bias element seat comprising an open end and a bias element engagement surface opposite said open end.

19. A socket for an electronic package, comprising:

a cover and a base slidably joined with one another and being movable relative to one another along a longitudinal axis between an open position for loading the electronic package and a closed position engaging the electronic package to the base;

a sliding cam assembly sliding and moving said cover between said open and closed positions, said cam assembly adapted for linear displacement in a direction perpendicular to said longitudinal axis;

a rotatably mounted lever configured to engage and displace said cam assembly when said lever is rotated about a rotational axis aligned parallel to said longitudinal axis; and said cam assembly having a bias element seat and a bias element positioned between said cover and base without contacting said lever, said bias element exerting a force upon said cam assembly to ensure that said cover is in an open position relative to said base when said lever is actuated to open the socket.

* * * * *